US008657764B2

(12) United States Patent
King

(10) Patent No.: US 8,657,764 B2
(45) Date of Patent: Feb. 25, 2014

(54) GAS-DRIVEN CHEST COMPRESSION APPARATUS

(75) Inventor: Ben King, Takaka (NZ)

(73) Assignee: Physio-Control, Inc., Redmond, WA (US)

( * ) Notice: Subject to any disclaimer, the term of this patent is extended or adjusted under 35 U.S.C. 154(b) by 1164 days.

(21) Appl. No.: 12/525,402

(22) PCT Filed: Jan. 25, 2008

(86) PCT No.: PCT/SE2008/000063

§ 371 (c)(1),
(2), (4) Date: Sep. 18, 2009

(87) PCT Pub. No.: WO2008/097153

PCT Pub. Date: Aug. 14, 2008

(65) Prior Publication Data

US 2010/0004572 A1 Jan. 7, 2010

(30) Foreign Application Priority Data

Feb. 8, 2007 (SE) ..... 0700304

(51) Int. Cl.
*A61H 31/00* (2006.01)

(52) U.S. Cl.
USPC ..... 601/41; 601/44

(58) Field of Classification Search
USPC ..... 601/41, 42, 43, 44, 148–152
See application file for complete search history.

(56) References Cited

U.S. PATENT DOCUMENTS

| | | | | |
|---|---|---|---|---|
| 4,928,674 | A * | 5/1990 | Halperin et al. | 601/44 |
| 5,490,820 | A * | 2/1996 | Schock et al. | 601/41 |
| 6,349,746 | B1 | 2/2002 | Bergemann et al. | |
| 2003/0004445 | A1 * | 1/2003 | Hall et al. | 601/41 |

FOREIGN PATENT DOCUMENTS

EP 0 146 261 A1 6/1985

OTHER PUBLICATIONS

International Search Report dated Apr. 25, 2008, issued in corresponding international application No. PCT/SE2008/000063.

* cited by examiner

*Primary Examiner* — Quang D Thanh
(74) *Attorney, Agent, or Firm* — Marger Johnson & McCollom PC

(57) ABSTRACT

A gas-driven chest compression apparatus for cardiopulmonary resuscitation (CPR) comprises a flexible pneumatic actuator, capable of axial contraction when fed with a pressurized driving gas, and means for controlling the contraction thereof. Also disclosed are methods of providing chest compressions to a patient by means of a CPR apparatus comprising actuator(s) of this kind, and a corresponding use of the actuator.

23 Claims, 7 Drawing Sheets

Fig. 6a
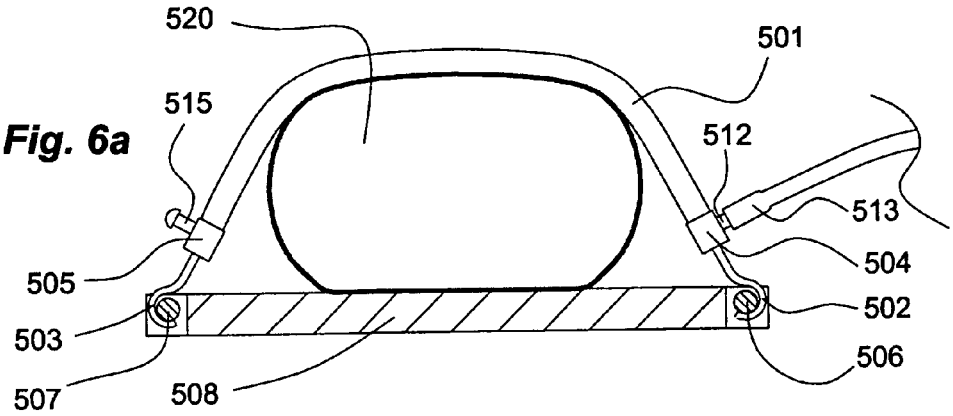
Fig. 6b
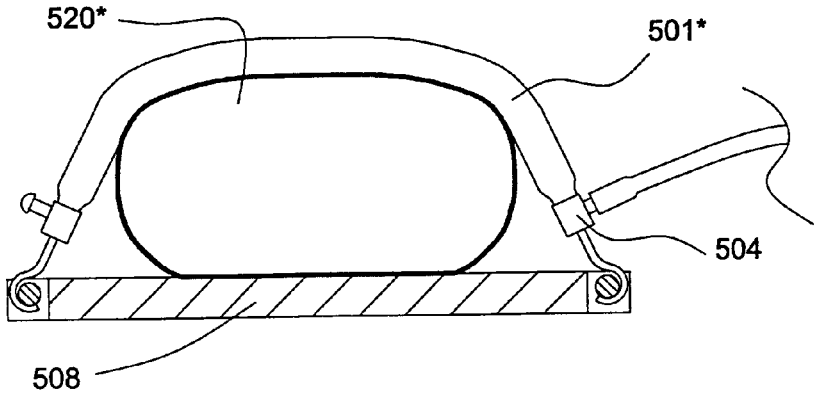
Fig. 7
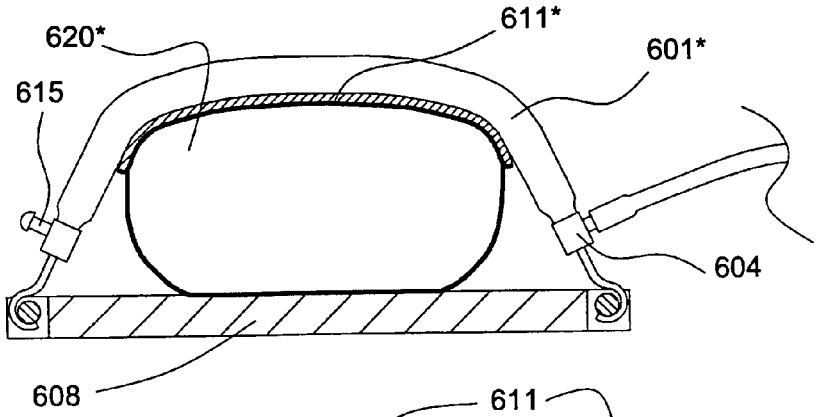
Fig. 7a
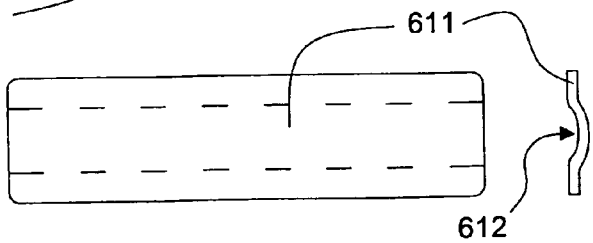
Fig. 7b

GAS-DRIVEN CHEST COMPRESSION APPARATUS

CROSS REFERENCE TO RELATED APPLICATIONS

The present application is a 35 U.S.C. §371 National Phase conversion of PCT/SE2008/000063, filed Jan. 25, 2008, which claims benefit of Swedish Application No. 0700304-9, filed Feb. 8, 2007, the disclosure of which is incorporated herein by reference. The PCT International Application was published in the English language.

FIELD OF THE INVENTION

The present invention relates to a gas-driven chest compression apparatus for cardiopulmonary resuscitation.

BACKGROUND OF THE INVENTION

Sudden cardiac arrest is commonly treated mechanically and/or by electrical defibrillation. Mechanical treatment may be given manually or by a chest compression apparatus. A number of chest compression apparatus are known in the art, such as the pneumatically driven LUCAS™ mechanical chest compression system ("Lucas™ system"; an apparatus for compression and physiological in CardioPulmonary Resuscitation, CPR, manufactured by Jolife AB, Lund, Sweden). Specifically the Lucas™ system comprises a support structure and a compression unit. The support structure includes a back plate for positioning under the patient's back posterior to the patient's heart and a front part for positioning around the patient's chest anterior to the heart. The front part has two legs, each having a first end pivotally connected to a hinge of the front part and a second end removably attachable to the back plate. The front part is devised to centrally receive the compression unit, which is arranged to repeatedly compress the patient's chest. The compression unit comprises a pneumatic means arranged to drive and control compression, an adjustable suspension means to which a compression pad is attached, and a means for controlling the position of the pad in respect of the patient's chest. The use of a pneumatic means as the driving force relies on a reciprocating piston providing compressions on the chest by the pad, driven by pressurized gas. The system utilizes pressurized gas for driving the piston both ways, i.e. in the direction of the patient's chest (compression phase, gas being supplied to a compression chamber) and then in the opposite direction (gas being supplied to a decompression chamber), whereby the sternal portion of the chest is brought back to its original position (decompression phase). The consumption of pressurized gas can be substantial and is a limiting feature on the use of the apparatus in places where supply of pressurized driving gas is limited. The consecutive supply of driving gas to the two chambers of the known apparatus requires a complex and thus expensive valve system and a correspondingly complex control.

OBJECTS OF THE INVENTION

It is an object of the present invention to provide an apparatus of the aforementioned kind, which only consumes pressurized gas when the chest compression pad imposes a force on the patient's sternum.

It is another object of the invention to provide an apparatus of the aforementioned kind, in which the control of driving gas is simplified.

Further objects of the invention will be evident from the following summary of the invention, the description of preferred embodiments thereof illustrated in a drawing, and the appended claims.

SUMMARY OF THE INVENTION

According to the present invention is disclosed the use of an axially contractible pneumatic actuator as a driving force generator for an apparatus for cardiopulmonary resuscitation by administration of chest compressions to a patient in need thereof. In this application "actuator" refers to an axially contractible flexible pneumatic actuator.

An axially contractible flexible pneumatic actuator suitable for the use in the present invention is disclosed in EP 0 146 261. The actuator comprises a hose body extending between two spaced head pieces. The hose body is flexible whereas the end pieces are solid and generally of a metal. When a fluid under pressure, such as a driving gas, is adduced to its lumen the hose body expands radially. Thereby the distance between the head pieces is shortened. This shortening or contraction can be used as a pulling force. The contraction force of the known actuator is proportional (however not linearly) to the pressure of the driving gas. An actuator of this kind can be used, for instance, to lift or pull weights. An improved pneumatic actuator of this kind is disclosed in U.S. Pat. No. 6,349,746, which is incorporated herein by reference.

According to the present invention is also disclosed a CPR apparatus comprising one or more axially contractible flexible pneumatic actuators driven by pressurized gas, in particular pressurized breathing gas. It is preferred for the CPR apparatus to comprise a back plate on which a patient in need of CPR is resting with his back, one or both ends of the one or more actuators being fixed at the back plate. The back plate is preferably oblong in a transverse direction, in particular about rectangular. Fixation of the one or more actuators at the back plate is preferably at the short sides of the plate, which is of a transverse length so at to extend at both sides of the patient. It is also preferred for the CPR apparatus to comprise a chest compression pad on which the one or more actuators act for compression of the patient's chest. It is also preferred to arrange a base plate between the compression pad and the actuator. The back plate and the compression pad may be integral or separate.

According to a first preferred aspect of the invention the CPR apparatus comprises an actuator fastened at the back plate at its both ends, at least one end being releasably fastened. In such case it is preferred for the actuator to abut to the base plate or to an element in abutment with the base plate. Particular preferred is the disposition of the portion of the actuator abutting the base plate in a slot or groove in the upper face of the base plate. It is preferred for the portions of the base plate or of an element disposed between the base plate and the actuator that are in contact with the actuator to have a smooth surface and a low coefficient of friction, such as a coefficient of friction of a polyfluorinated hydrocarbon polymer, in particular Teflon®. The element disposed between the base plate and the actuator can, for instance, be a coat of such polyfluorinated hydrocarbon.

According to a second preferred aspect of the invention the CPR apparatus comprises two actuators fixed to opposite sides of the back plate with the first ends and to the base plate with their second ends. In this context "fixed to" comprises fixation via intermediate connection means, such as hooks, rods with eyes, straps, belts, etc. At least one of the fixations should be releaseable to facilitate the mounting of the apparatus to the patient.

According to a third preferred aspect the one or more actuators of the CPR apparatus of the invention are enclosed by optionally resiliently flexible shielding tubes. It is preferred for the one or more actuators to be arranged displaceable in the shielding tubes; in such case it is also preferred for the portion(s) of the inner face of the shielding tubes in contact with an actuator to have a low coefficient of friction, such as one of a polyfluorinated hydrocarbon polymer, in particular Teflon®. It is also preferred for such inner face to have a coat of a polyfluorinated hydrocarbon or other low-friction polymer.

A preferred polymer for any of base plate, back plate, and compression pad is polyamide reinforced with carbon, glass or other fibre.

According to a fourth preferred aspect of the invention an actuator is provided at its one end with a quick coupling of known kind by which it can be releasably fixed to the driving gas line or a gas conduit in the base plate or the back plate. If fixed to a gas conduit in the base plate or the back plate, the quick coupling must be one that withstands the pulling strain exerted on it during contraction of the actuator. Quick couplings suitable for use in the invention are, for instance, low pressure monocouplings series LS manufactured by Carl Kurt Walther GmbH & Co. KG (Haan, Germany).

According to a fifth preferred aspect of the apparatus of the invention comprises a releaseable means for adjustment of the position of the base plate/compression pad assembly in respect of the patient, so as to fix the compression pad in a position in which it abuts the breast of the patient while not compressing it and while the one or more unloaded actuator are kept in a straightened state. The adjustment means is preferably selected from means for adjusting the position of the compression pad in respect of the base plate or/and the position of the base plate in respect of the back plate.

According to a sixth preferred aspect of the invention an actuator is provided with a resiliently compressible means such as a steel coil that accelerates the return from an inflated state to a non-inflated state. It is preferred for the resiliently compressible means to partially or fully enclose the actuator.

According to a seventh preferred aspect of the invention the CPR apparatus comprises a means for control of driving gas of constant pressure supplied by a driving gas source such as a gas cylinder provided with a pressure reduction valve, the means comprising a valve for adducing and venting drive gas to/from the actuator controlled by a timing module optionally coupled to pressure sensor, and optionally comprising a mechanically operated safety valve.

According to a further preferred aspect of the invention the gas for driving the actuator is air. Air vented from the actuator can be adduced to the lungs of the patient by a breathing mask or by intubation.

According to the present invention is also disclosed the use of an axially contractible flexible pneumatic actuator in a CPR apparatus for providing chest compression to a patient in need thereof. The CPR apparatus may additionally comprise a means for providing electric stimulation to the heart.

The invention will now be explained in more detail by reference to preferred embodiments illustrated in a rough drawing.

DESCRIPTION OF THE FIGURES

FIG. 6*a* is a sectional view (in part, in a section corresponding to that of FIG. 1*b*) of a fifth embodiment of the apparatus of the invention, with the actuator in a non-inflated (inactive) state;

FIG. 6*b* is the apparatus of FIG. 6*a* and in the same view, with the actuator in an inflated (active) state;

FIG. 7 is a sectional view (in part, in a section corresponding to that of FIG. 1*b*) of a sixth embodiment of the apparatus of the invention, with the actuator in an inflated (active) state;

FIG. 7*a* is a top view of the compression plate of the embodiment of FIG. 7;

FIG. 7*b* is a short side view of the compression plate of FIG. 7*a;*

DESCRIPTION OF PREFERRED EMBODIMENTS

Figure 1A:
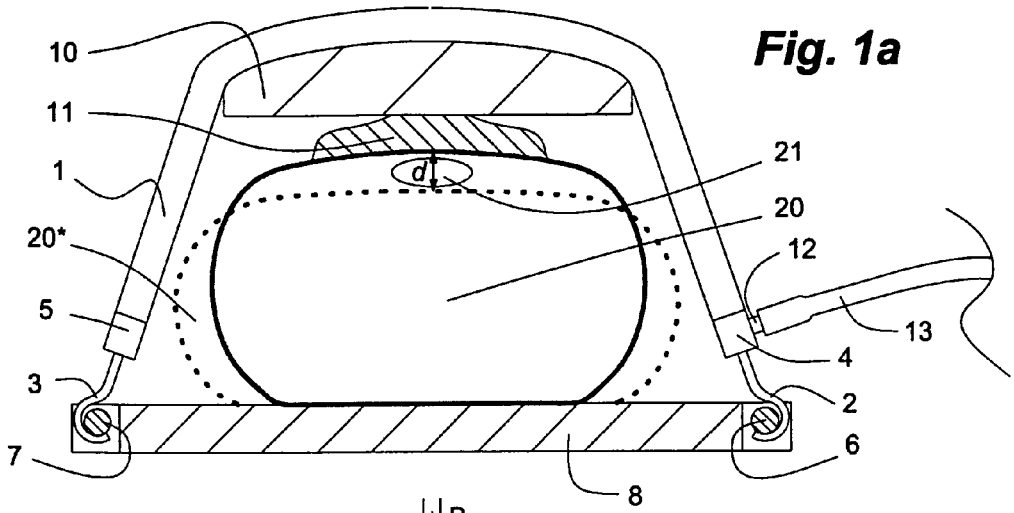
FIG. 1*a* is a sectional view (in part; section A-A in FIG. 1*c*) of a first embodiment of the apparatus of the invention, with the actuator in a non-inflated state (passive)
Figure 1B:
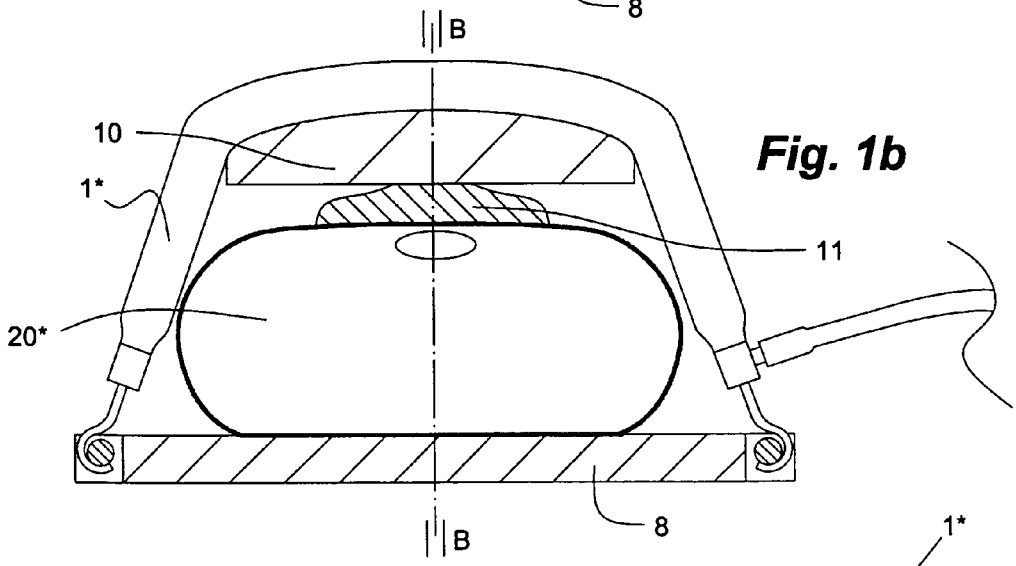
FIG. 1*b* is the apparatus of FIG. 1*a* and in the same view, with the actuator in an inflated (active) state.
Figure 1C:
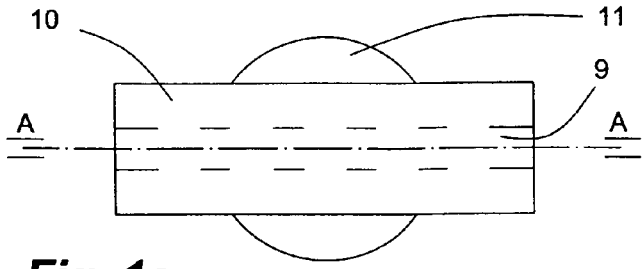
FIG. 1*c* is a top view of an actuator/compression plate/compression pad assembly of the embodiment of FIGS. 1*a* and 1*b;*
Figure 1D:
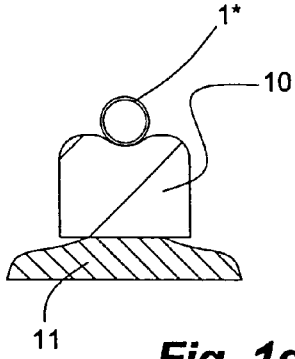
FIG. 1*d* is a enlarged sectional view B-B (FIG. 1*b*) of the assembly of FIG. 1*c;*

The chest compression apparatus of FIGS. 1*a* and 1*b* comprises a flexible oblong pneumatic actuator 1 ("Fluid Muscle", Festo AG, Esslingen, Germany; inner diameter 20 mm, length 60 mm; model DSMP-20-550N) of the kind disclosed in U.S. Pat. No. 6,349,746 B1. A reference number provided with an asterisk indicates that the referenced element is physically changed by inflation of a actuator or is the inflated actuator. By hooks 2, 3 extending in opposite directions from head pieces 4, 5 the actuator 1 is attached to eyes 6, 7 mounted at opposite short sides of a glass fibre reinforced polyamide back plate 8 on which a the chest 20 of a patient under cardiopulmonary resuscitation is resting in a recumbent position. The actuator 1 partly encloses the chest 20 at the height of the sternum 21. In this mounted state the actuator 1 is bent so as to form an inverse U. The central portion of the actuator 1 corresponding to the base of the inverse U is disposed in a transversal slot 9 in the upper face of an generally rectangular base plate 10 of same material as the back plate 8 (FIGS. 1*c*, 1*d*). During inflation and deflation portions of the actuator's 1 outer face glide in the slot 9. To facilitate gliding the slot 9 surface should be as smooth as possible and preferably of a material or covered by a coat of low friction. A suitable coat material is Teflon® or another polyfluorinated hydrocarbon polymer. From the lower face of the base plate 10 extends a circular compression pad 11 provided with a flexible circumferential lip (not shown) at its lower face, which abuts the breast of the patient above the sternum 21. A short radial pneumatic connection pipe 12 extends from one head piece 4. Compressed air for inflating the actuator 1 is adduced by a flexible high-pressure air hose 13 mounted at the pipe 12.

In FIG. 1*b* the actuator 1* is shown in a state inflated by air of 5 bar. The actuator 1*, which has been inflated against the resistive force of the chest 20 of about 350 N, is shortened by about 16%. Thereby the chest 20* has been compressed to a depth of about 50 mm. The actuator 1* can be deflated via the air hose 13 or a venting valve (not shown) arranged, for instance, at the opposite head piece 5.

Figure 2A:
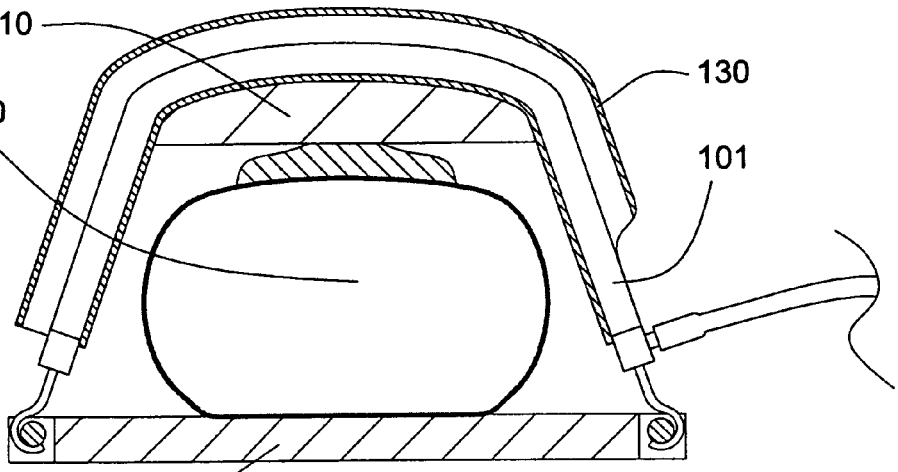
FIG. 2*a* is a sectional view (in part, in a section corresponding to that of FIG. 1*a*) of a second embodiment of the apparatus of the invention, with the actuator in a non-inflated (passive) state.
Figure 2B:
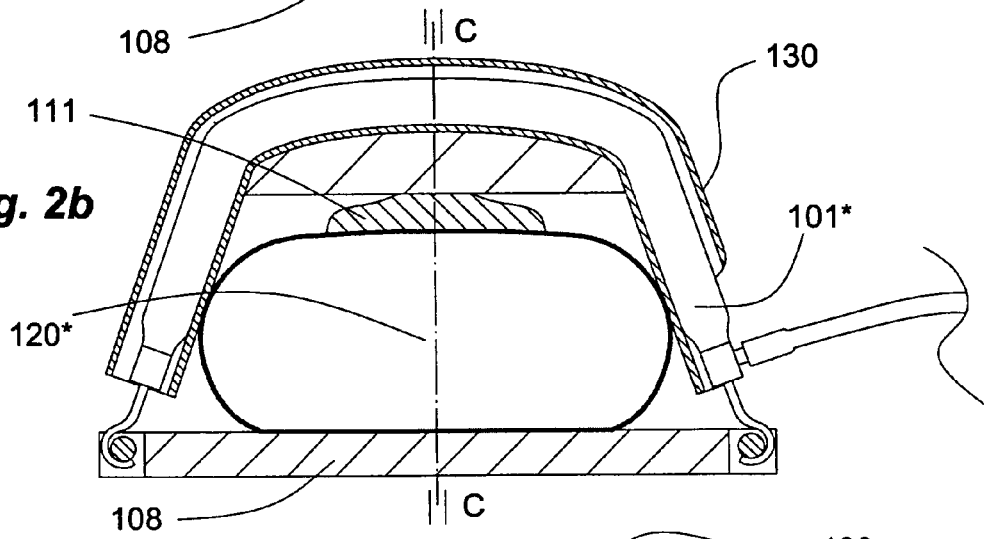
FIG. 2*b* is the apparatus of FIG. 2*a* and in the same view, with the actuator in an inflated (active) state.
Figure 2C:
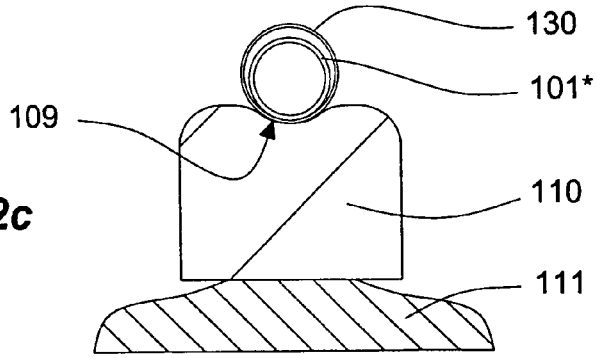
FIG. 2*c* is sectional enlarged view C-C (FIG. 2*b*) of an actuator/compression plate/compression pad assembly of the embodiment of FIGS. 2*a* and 2*b* including a shielding tube.

The second embodiment of the apparatus of the invention shown in FIGS. 2*a*-2*c* of a patient shares its general design with that of the first embodiment of FIGS. 1*a*-1*d*. It comprises a back plate 108, a pneumatic actuator 101 releasably fastened to the back plate 108 at its both ends, a base plate 110 and a compression pad 111. It differs from the first embodiment in that the actuator 101, except for its end portions, is disposed in shielding tube 130. The aim with the shield tube 130 is to protect the patient from damage by an exploding actuator 101*, and also from contact with the moving actuator 101, 101*. The shielding tube 130 is disposed in a slot 109 of the base plate 110 corresponding to the slot 9 of the embodiment of FIGS. 1*a*-1*d*. The shielding tube 130 is held in the slot 109 clamped by the actuator 101, 101* but can also be attached to the slot wall by, for instance, an adhesive or welding. The inner face of the shielding tube 130, against which the actuator 101, 101* glides during inflation and deflation, should have a low-friction surface. The shielding tube 130 of FIGS. 2*a*-2*c* is somewhat flexible to allow it to adapt to the slightly changing angle of the actuator 101, 101* legs during a compression cycle. Alternatively the shielding tube 130 can be of a stiff material provided that its lumen is wide enough to accommodate the changing angle and diameter of the actuator 101, 101* over a compression cycle.

Figure 3A:
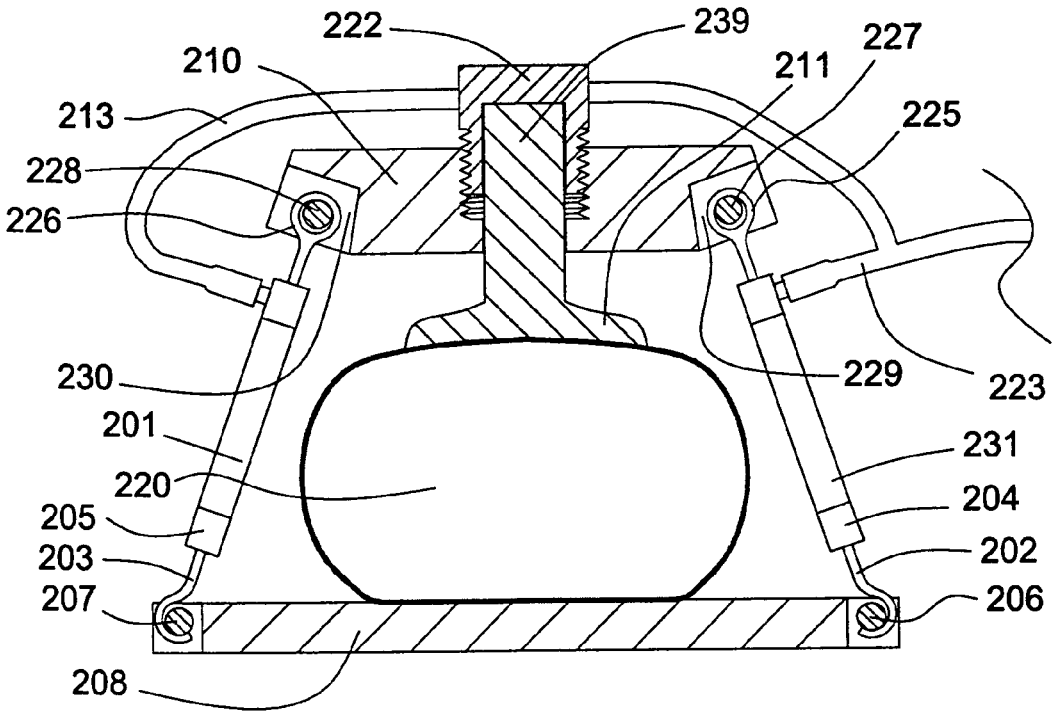
FIG. 3*a* is a sectional view (in part, in a section corresponding to that of FIG. 1*a*) of a third embodiment of the apparatus of the invention, with the actuator in a non-inflated (passive) state.
Figure 3B:
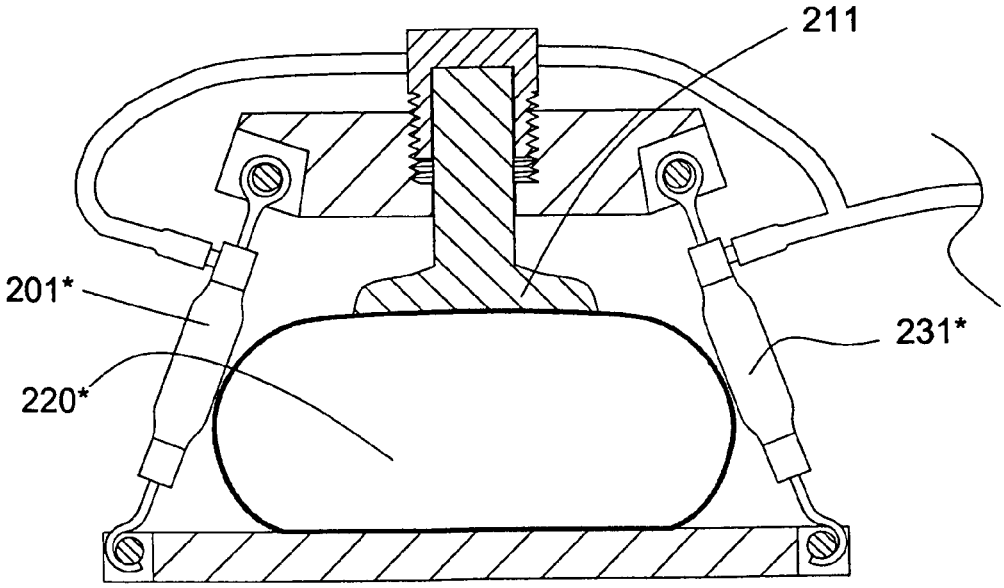
FIG. 3*b* is the apparatus of FIG. 3*a* and in the same view, with the actuator in an inflated (active) state.

The third embodiment of the apparatus of the invention shown in FIGS. 3*a* and 3*b* comprises two pneumatic actuators 201, 231 of equal length and properties (inner diameter: 20 mm; length: 40 cm). The actuators 201, 231 have hooks 203, 202 extending axially from their first ends 205, 204, by which they are attached to eyes 207, 206 fixed to and extending from opposite short sides of a rectangular back plate 208. From the second ends of the actuators 201, 231 rods carrying terminal eyes 226, 225 extend in axial directions. The eyes 226, 225 are mounted on bars 228, 227 bridging slits 230, 229 in a base plate 210. The rod 239 of a compression pad 211 is mounted displaceably in a central through bore of the base plate 210, of which a portion extending from the upper end is threaded. Compressed air is fed to the actuators 201, 231 by branches 213, 223 of a flexible high pressure gas hose. The apparatus is mounted to the patient's chest 220 in the following manner: the compression pad 211 with the rod 239 disposed in the base plate 210 is placed on the patient's chest and centred on the sternum. It is held there while sliding the base plate 210 upwards along the rod 239 until further displacement is hindered by the straightened actuators 201, 231. A threaded stop 222 is screwed into the bore until stopped by the end face of the rod 239. This arrangement allows to adapt the apparatus to the size of the chest 220 of an individual patient. In the inflated state of the actuators 201*, 231* shown in FIG. 3*b*, the compression pad 211 has compressed the chest 220* of the patient by about 50 mm at a driving gas pressure of 4 bar.

Figure 4:
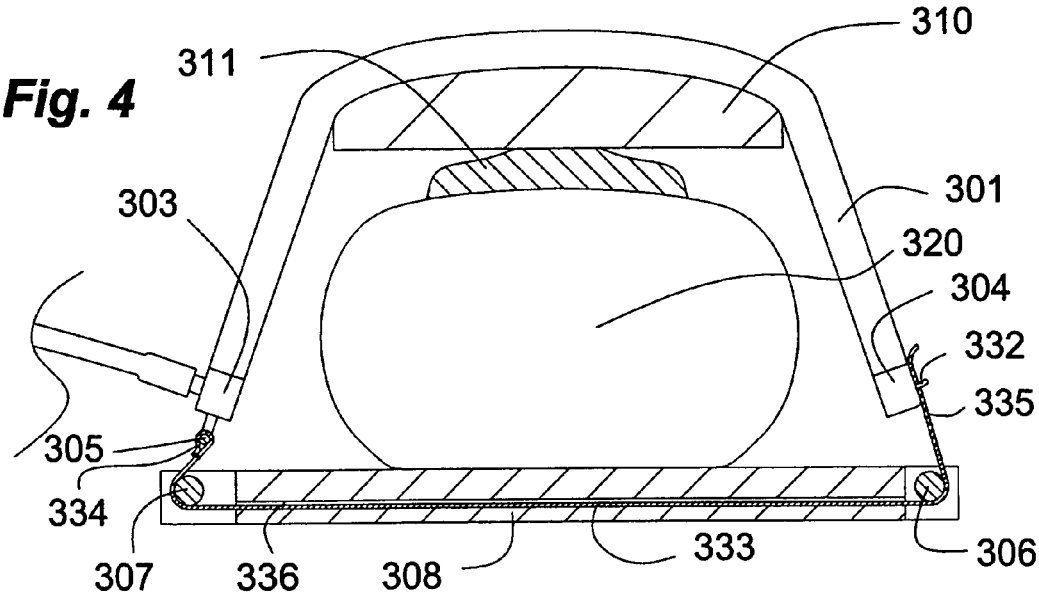
FIG. 4 is a sectional view (in part, in a section corresponding to that of FIG. 1*b*) of a fourth embodiment of the apparatus of the invention, with the actuator in an inflated (active) state.

In a fourth embodiment of the apparatus of the invention shown in FIG. 4 comprising a single actuator 301, the hook means of the embodiments described in the foregoing are replaced by a polyester belt 333. One end of the belt 333 is fastened at an eye 305 of one end piece 303 of the actuator 311. A belt portion extending from the other end of the belt 333 is provided with a row of holes 335, by any of which the belt 333 can be fasted at a mandrel 332 extending radially from the other end piece 304. The intermediate portion of the belt 333 is disposed in a channel 336 extending from one short side of the back plate 308 to the other side. Most of the load working on the belt 333 is taken up by deflection pins 307, 306 disposed in a manner corresponding to the eyes 7, 6 of the first embodiment. Reference numbers 310, 311 designate a base plate and a compression pad of same design as those of the first and second embodiments.

Figure 5:
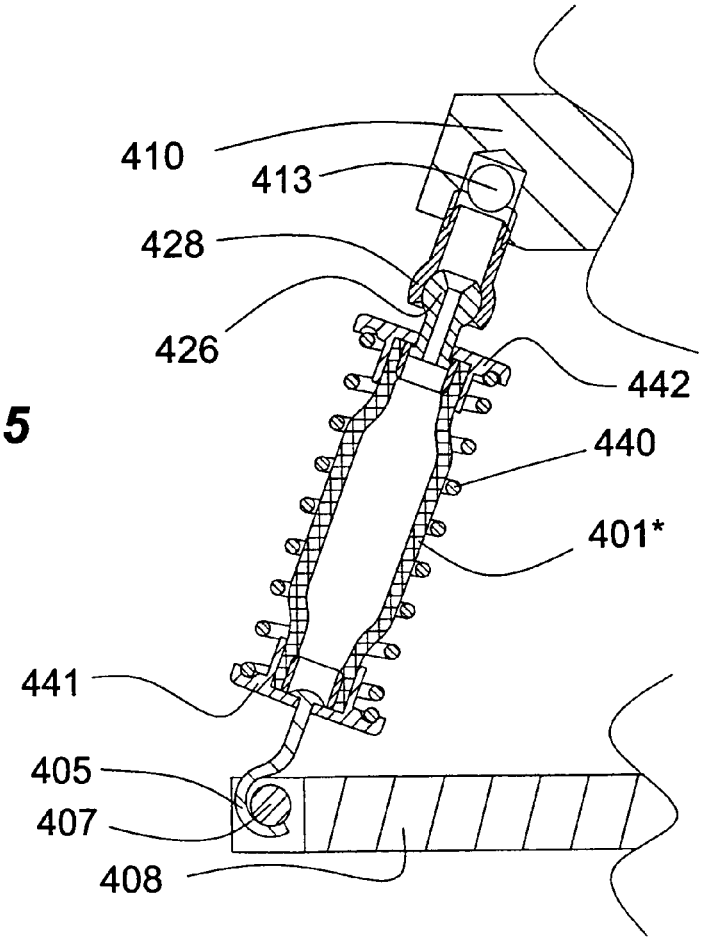
FIG. 5 is an partial view of a fifth embodiment of the apparatus of the invention, in a section corresponding to that of FIG. 1*a*, with the actuator in an inflated (active) state.
Figure 8:
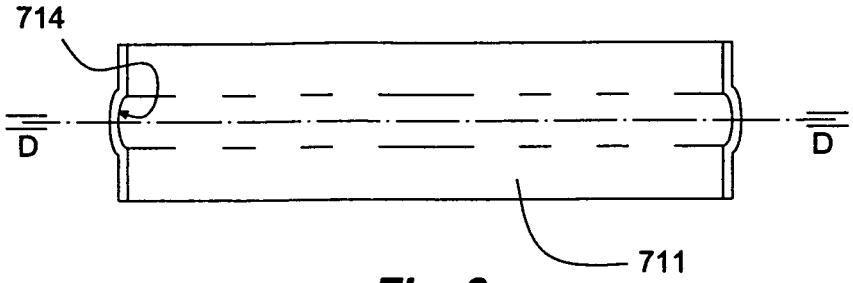
FIG. 8 is a variation of the compression plate of FIG. 7*a*, in a top view.
Figure 8A:
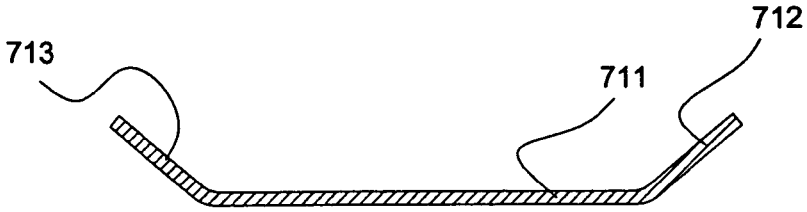
FIG. 8*a* is a sectional view D-D (FIG. 8) of the compression plate of FIG. 8.
Figure 8B:
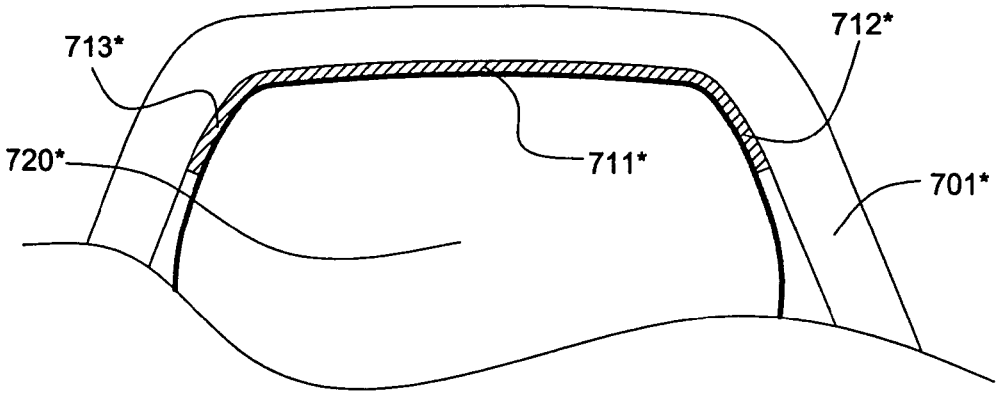
FIG. 8*b* is a partial view of the compression plate of FIG. 8 in a state mounted on the chest of a patient, the view corresponding to that of FIG. 1*a;*
Figure 9:
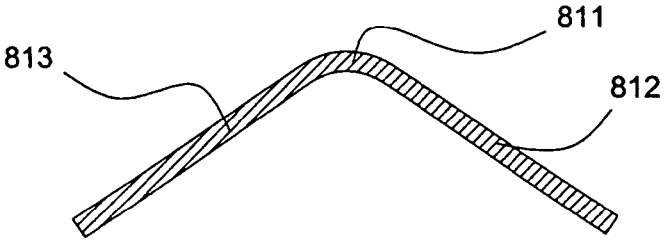
FIG. 9 is a variation of the compression plate of FIG. 8, in a sectional view corresponding to that of FIG. 8*a;*

In a fifth embodiment of the apparatus of the invention similar to that of FIGS. 3*a*, 3*b* in respect of the use of two actuators of same size and properties, the actuators, of which only one actuator 401* is shown in FIG. 5 in an inflated state, are working against a resiliently compressible means. One reason for this arrangement is to make the first inflated actuator 401* and the second inflated actuator (not shown) return to their original non-inflated configuration as soon as they are deflated. In the embodiment of FIG. 5, the resiliently compressible means is a steel coil 440 held between first and second support flanges 441, 442 of the actuator's 401 first and second end pieces, respectively. A hook 405, by which the apparatus is fastened at an eye 407 of the back plate 408, is mounted in a central bore of the first end piece. The female part 426 of a ball-and-socket joint is mounted at the actuator's 401* second end piece, while the male part 428 is mounted in a threaded bore a base plate 410. A conduit 413 in the base plate 410 provides communication between a source of compressed air and the actuator 401*. The ball-and-socket joint of the embodiment can be exchanged for a series LS quick coupling of a width of 23 mm (Carl Kurt Walther GmbH & Co. KG (Haan, Germany) the nipple and the coupling housing provided with threaded end portions matching the thread of an axial bore of the second end piece and of the bore in the base plate. The coupling housing and the nipple may be mounted at the base plate or the actuator, respectively.

A CPR apparatus of the invention that comprises only one pneumatic actuator, such as the apparatus of FIGS. 1*a*-1*d*, can be provided with a resiliently compressible means of the aforementioned kind by, for instance, arranging one compressible steel coil each around the arms of the U-formed actuator. At their one end the coils are supported by a flange of the respective end piece. At their other end the coils are supported by a flange mounted at lateral sections of the base plate, in particular close to the respective end of the groove in which the base of the actuator is disposed. Alternatively a single compressible steel coil extending from a support flange of one end piece to a support flange the other end piece could be used, an intermediate section of the coil being disposed in the groove of the base plate.

The fifth embodiment of the apparatus of the invention illustrated in FIGS. 6*a*, 6*b* corresponds generally to that of FIGS. 1*a*, 1*b*. The chest 520 of the patient is strapped by a single actuator 501 to a back plate 508 but without any interposed element. At both ends the actuator 501 is fastened to eyes 506, 507 extending laterally from the back plate 508 by means of hooks 502, 503 extending from head pieces 504, 505 of the actuator 501. Compressed air is adduced to the actuator 501 via a flexible tube 513 mounted at a connection pipe 512 of head piece 504. The actuator 501 is vented by a solenoid valve 515 arranged at the other head piece 515; an advantage with this arrangement is that the temperature of the actuator 501 does rise less than if it is vented via the same end. In its expanded state 501* the actuator has shortened enough to compress the chest by about 30 mm which, while not optimal, is an acceptable compression depth. A major advantage of this and the following embodiments is its simplicity.

The sixth embodiment of the apparatus of the invention illustrated in FIG. 7 with its actuator 601* in a an expanded (active) state comprises a compression plate 611* disposed between the chest 620* of a patient and the actuator 601* in a bended state. The resiliently flexible oblong compression plate 611, which is shown in a top view and a side view in FIGS. 7*a* and 7*b*, respectively, in an unloaded (not bended) state, is substantially flat except for a longitudinally extending slot 612. In a mounted state the actuator 601 is disposed in the slot 612 to keep the compression plate 611 from moving in a cranial or opposite direction in respect of the actuator 611. The resilient nature of the compression plate 611, which seeks to regain its original flat state from the bended state shown in FIG. 7, supports the actuator in assuming its full length or inactive state 611 at the end of the compression phase. Elements identified in FIG. 7 by reference numbers 604, 608, 615 correspond to elements 504, 508, 515 in FIG. 6*a*.

Variations of the compression plate 611 are shown in FIGS. 8, 8*a*, 8*b*, and FIG. 9, respectively. The first variation is U-formed in a longitudinal section D-D and comprises a centrally disposed slot 714 in which the actuator 701 can be disposed. The wings 712, 713 extending from either side of the base 711 increase the resilient spring action of the compression plate when mounted in-between the actuator 701 shown in an expanded state 701* in FIG. 8*b*. In the mounted state of the compression plate the wings 712*, 713* are bent downwards. When the compressed air is vented from the actuator 701*, the wings 712*, 713* flap back to their original state 712, 713, thereby lifting up and thus extending the actuator 701*. The V-formed variation of the compression plate 811, 812, 813 shown in FIG. 9 exerts an uplifting effect on an actuator also by its central portion 811 when mounted between the actuator and the chest of a patient in a manner corresponding to that of compression plate 711.

Figure 10:
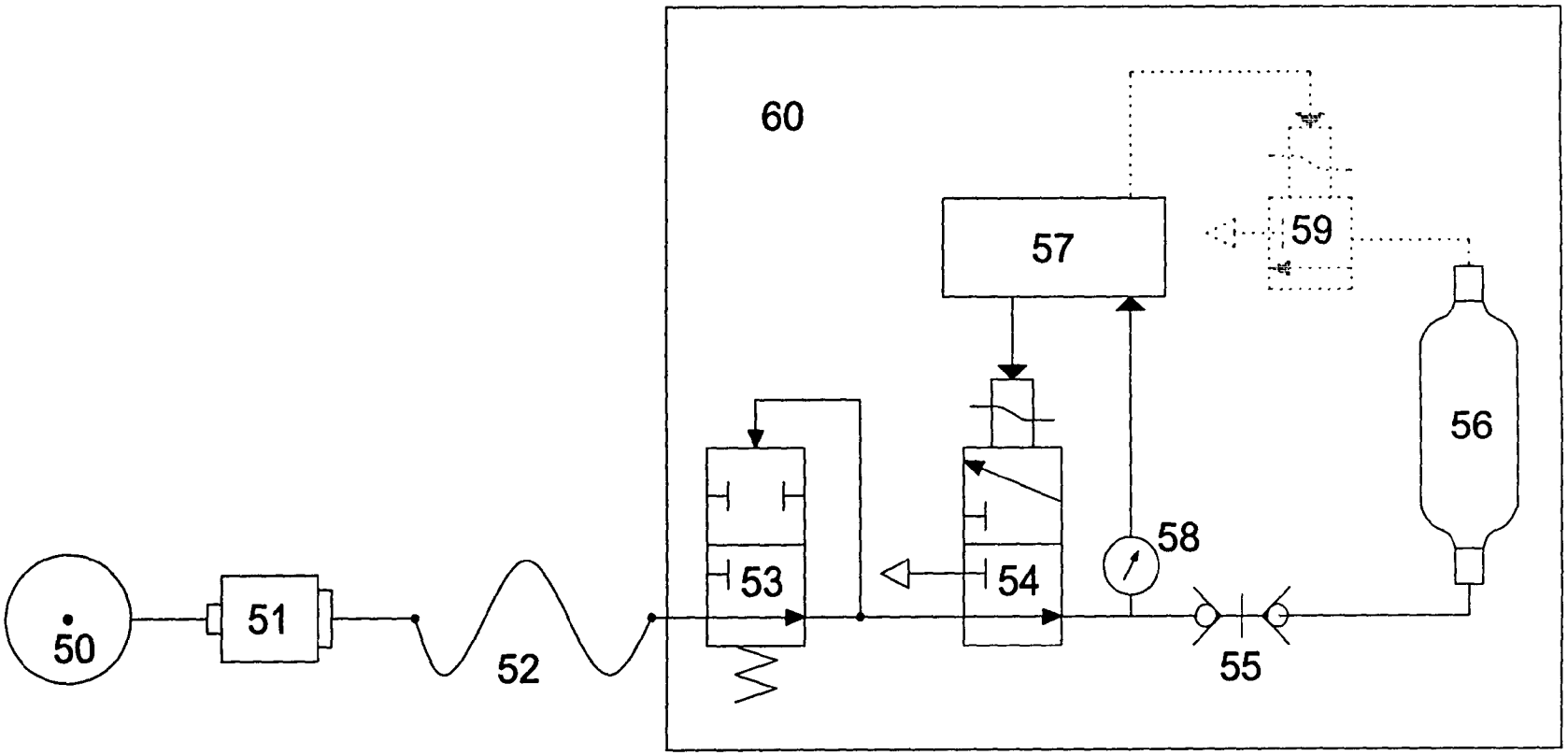
FIG. 10 is a pneumatic control scheme for an apparatus of the invention.

In the pneumatic control scheme for an apparatus of the invention illustrated in FIG. 10 compressed air is provided from a gas flask 50 to expander module 51 in which the gas is expanded to the driving pressure. The driving pressure can vary depending on the length and diameter of the actuator and on the design of the apparatus, but will generally be in the interval of from about 2 to about 4.5 bar. Via a flexible pressure line 52 the driving gas is adduced to the apparatus 60, where it passes a safety valve 53 that is mechanically vented at a selected pressure. A 3/2 solenoid-actuated valve 54 controlled by a timing module 57 optionally comprising a pressure sensor 58 supplies driving gas to one or several actuators of which only actuator 56 is shown. A self-sealing quick-coupling 55 is provided in the line between the 3/2-valve 54 and the actuator 56. Over a compression/decompression cycle the driving gas supply and control system of FIG. 6 provides driving gas to the actuator 56 to make it expand and thereby displace the compression pad of one of the aforementioned embodiments in contact with the sternal region of a patient towards the heart of the patient, thereby providing heart massage and expelling air from the lungs. The actuator 56 is kept in an expanded state for a selected period of time and then deflated by via the venting outlet of the 3/2 valve 54. The 3/2 valve 54 then is switched to the starting position of a new compression/decompression cycle. The actuator 56 can also be driven in a manner, in which equilibrium between the pressure of the driving gas provided to the actuator 56 and the pressure of the driving gas set by the expander module is not established. In such case a higher driving gas pressure than at equilibrium conditions will be used but will be provided to the actuator 56 only during an initial portion of the compression phase. An alternative exhaust path is indicated in broken lines. In the alternative path the actuator is vented, optionally to an intubation set or a breathing mask (not shown) via its end opposite to that coupled to valve 55 via a solenoid actuated exhaust valve 59 controlled by the timing module 57; in this variation the exhaust function of valve 54 is inoperative.

What is claimed is:

1. A gas-driven chest compression apparatus for cardiopulmonary resuscitation, comprising:

a first flexible pneumatic actuator capable of axial contraction when fed with a pressurized driving gas;

a controller configured to control the contraction of the first flexible pneumatic actuator;

a back plate to which one or both ends of the first flexible pneumatic actuator are fastened; and a base plate disposed between the first flexible pneumatic actuator and the chest of a patient resting on the back plate, wherein the base plate includes a slot in which a portion of the first flexible pneumatic actuator is received.

2. The apparatus of claim 1, wherein the controller is connected to a supply of pressurized driving gas of a constant pressure, the pressurized driving gas including pressurized air, the controller including a valve manifold that adduces driving gas to and selectively vents driving gas from the first flexible pneumatic actuator, the valve manifold being controlled by a timing module coupled to a pressure sensor and including a mechanically operated safety valve.

3. The apparatus of claim 1, wherein the first flexible pneumatic actuator comprises a flexible hose body extending between two head pieces of solid material.

4. The apparatus of claim 3, wherein driving gas is vented from the first flexible pneumatic actuator by either of the head pieces.

5. The apparatus of claim 4, wherein the driving gas is vented from the venting head piece through a venting valve controlled by the timing module.

6. The apparatus of claim 1, wherein the first flexible pneumatic actuator is releasably fastened to one or both ends of the back plate.

7. The apparatus of claim 1, comprising a resiliently flexible shielding tube in which a portion of the first flexible pneumatic actuator is positioned within the shielding tube.

8. The apparatus of claim 1, wherein the base plate is resiliently flexible.

9. The apparatus of claim 1, comprising a compression pad mounted at or integral with a face of the base plate that is opposite the first flexible pneumatic actuator.

10. The apparatus of claim 9, wherein the compression pad is movable in a direction perpendicular to the base plate.

11. The apparatus of claim 1, wherein the first flexible pneumatic actuator includes a quick coupling for connecting the first flexible pneumatic actuator to a gas conduit, or to a driving gas line.

12. The apparatus of claim 1, wherein the slot has a surface that includes a low friction material.

13. A gas-driven chest compression apparatus for cardiopulmonary resuscitation, comprising:

a first flexible pneumatic actuator capable of axial contraction when fed with a pressurized driving gas;

a controller that controls the contraction of the first flexible pneumatic actuator;

a second flexible pneumatic actuator capable of axial contraction when fed with a pressurized driving gas, wherein the controller also controls the contraction of the second flexible pneumatic actuator;

a back plate to which first ends of each of the first flexible pneumatic actuator and the second pneumatic actuator are fastened; and a base to which second ends of each of the first pneumatic actuator and the second pneumatic actuator are fastened.

14. The apparatus of claim 13, wherein the base includes a compression pad mounted at a face of the base that faces the back plate.

15. The apparatus of claim 14, wherein the compression pad is movable in a direction perpendicular to the base.

16. The apparatus of claim 13, further comprising a resiliently compressible element mounted to at least one of the first and second actuators.

17. The apparatus of claim 16, wherein the resiliently compressible element includes a spring coil enclosing the hose and mounted with its one end at one head piece and with its other end at the other head piece, the one head piece also attached to the first actuator and the other head piece also attached to the second actuator.

18. The apparatus of claim 13, wherein the second actuator includes a quick coupling for connecting the second actuator to a gas conduit in the base or the back plate or to a driving gas line.

19. The apparatus of claim 13, comprising an adjustment element that adjusts the position of the base with respect to the back plate.

20. A method of providing chest compressions to a patient, comprising:

disposing a chest of the patient in a recumbent position on a back plate;

mounting a flexible pneumatic actuator capable of axial contraction when fed with a pressurized driving gas with its ends at opposite sides of the back plate so as to enclose and abut the chest of the patient;

disposing a compression plate element between the flexible pneumatic actuator and the chest to effect said abutment, the compression plate element having a slot into which a portion of the flexible pneumatic actuator is received; and intermittently inflating and deflating the flexible pneumatic actuator.

21. The method of claim 20, wherein the rate of intermittent inflation and deflation is from 60 $min^{-1}$ to 150 $min^{-1}$.

22. A method of providing chest compressions to a patient, comprising:

disposing a chest of the patient in a recumbent position on a back plate;

disposing a compression base on the chest of the patient above a sternum of the patient;

disposing at opposite sides of the patient's chest a first flexible pneumatic actuator and a second flexible pneumatic actuator, each of the first and second pneumatic actuators being capable of axial contraction when fed with a pressurized driving gas;

connecting the base, the flexible pneumatic actuators, and the back plate so that first ends of each of the first and second pneumatic actuators are fastened to the back plate and second ends of each of the first and second pneumatic actuators are fastened to the base so as to enclose the patient's chest; and intermittently inflating and deflating the flexible pneumatic actuators.

23. The method of claim 22, wherein the rate of intermittent inflation and deflation is from 60 $min^{-1}$ to 150 $min^{-1}$.

* * * * *